US006366030B1

(12) United States Patent
Ito et al.

(10) Patent No.: US 6,366,030 B1
(45) Date of Patent: Apr. 2, 2002

(54) STARTER CIRCUIT CONFIGURATION FOR A DISCHARGE LAMP LIGHTING CIRCUIT

(75) Inventors: Masayasu Ito; Hitoshi Takeda, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/596,719

(22) Filed: Jun. 19, 2000

(30) Foreign Application Priority Data

Jun. 21, 1999 (JP) ..... 11-174376

(51) Int. Cl.[7] ..... H05B 37/02
(52) U.S. Cl. ..... 315/291; 315/224; 315/307
(58) Field of Search ..... 315/307, 308, 315/224, 291, DIG. 5

(56) References Cited

U.S. PATENT DOCUMENTS 5,486,740 A 1/1996 Yamashita et al. ..... 315/308
5,932,976 A 8/1999 Maheshwari et al. ..... 315/291

FOREIGN PATENT DOCUMENTS

JP 9-223591 8/1997

*Primary Examiner*—David Vu
(74) *Attorney, Agent, or Firm*—Fish & Richardson P.C.

(57) ABSTRACT

A discharge lamp lighting circuit 1 has a starter circuit 5 for superposing a start signal to a discharge lamp 6 on AC voltage of a DC-AC conversion circuit 4 and applying to the discharge lamp 6. When a diode D1 conducts, a capacitor C2 placed at the output stage of a DC power supply circuit 3 is charged. When a diode D2 conducts, the charges accumulated in the capacitor D2 are transferred to a capacitor D3. As the charges are transferred from the capacitor C3 to a capacitor C1, the terminal voltage of the capacitor C1 is raised, then when the voltage finally reaches a sufficient voltage value for a switch element SWg to conduct (or break down), pulse voltage is generated in a primary circuit 10 of a transformer ST and is applied to the discharge lamp 6 through a secondary winding STb of the transformer ST.

5 Claims, 7 Drawing Sheets

STARTER CIRCUIT CONFIGURATION FOR A DISCHARGE LAMP LIGHTING CIRCUIT

BACKGROUND OF THE INVENTION

This invention relates to an art for supplying voltage to a starter circuit for applying a start signal to a discharge lamp for starting the discharge lamp in a discharge lamp lighting circuit.

The configuration of a lighting circuit of a discharge lamp, such as a metal halide lamp, comprising a DC power supply circuit, a DC-AC conversion circuit, and a starter circuit is known. For example, in the configuration wherein a DC-DC converter is used as a DC power supply circuit and a full-bridge type circuit comprising two pairs of semiconductor switch (or switching) elements for performing switching control and a driver circuit thereof are used for a DC-AC conversion circuit, the positive-polarity voltage (positive voltage) output by the DC-DC converter is converted into rectangular-wave voltage by the alternating operation of the full-bridge type circuit, then this voltage is supplied to a discharge lamp.

For the discharge lamp starter circuit, a method of increasing primary voltage generated in a primary circuit of a transformer (starter transformer) by the transformer and applying the increased voltage to the discharge lamp is known. However, how supply voltage to the primary circuit is generated becomes a problem. For example, the following methods can be named:

(1) Method of providing the primary voltage from output voltage of the DC power supply circuit or the DC-AC conversion circuit;

(2) method of providing the supply voltage (primary circuit voltage) by increasing output voltage of the DC-AC conversion circuit through a voltage doubler circuit, etc.,;

(3) method of providing the primary circuit voltage by adding a winding to the secondary side of a converter transformer placed in the DC power supply circuit and rectifying and smoothing output of the secondary winding.

First, the method (1) is intended for using the output voltage of the DC power supply circuit intact.

In the method (2), the output voltage after being increased through the voltage doubler circuit consisting of a diode and capacitor can be used as the primary circuit voltage. That is, a first capacitor and a switch element are provided in the primary circuit and the charges accumulated in a second capacitor are transferred to the first capacitor, whereby the terminal voltage of the first capacitor is raised. When the terminal voltage of the first capacitor reaches threshold voltage and the switch element conducts (or breaks down), the generated voltage may be increased by the transformer.

In the method (3), aside from a secondary winding for power output to the discharge lamp, a secondary winding is added to a converter transformer provided in the DC power supply circuit as the DC-DC converter, and the primary voltage can be used as the primary voltage to the starter circuit.

To light a discharge lamp more reliably, the voltage applied to the discharge lamp needs to be set to a reasonably high voltage (overcurrent voltage) temporarily before the discharge lamp lights up. The reason is as follows: When a start pulse generated by a starter circuit is applied to the discharge lamp and the discharge lamp breaks down, the tube voltage of the discharge lamp lowers, so that charges of a smoothing capacitor in a DC power supply circuit or charges of a capacitor in a current auxiliary circuit (for example, refer to JP-A-9-223591) provided at a later stage of the DC power supply circuit become an electric current to the discharge lamp and the reliability of the transition to ark discharge can be enhanced.

By the way, the above-described methods involve the following problems:

First, in the method (1), there is a tendency to raise the voltage increase ratio of the starter transformer and unless the inductance of the secondary winding of the transformer is made large, a start (pulse) signal of a sufficient crest value cannot be provided, thus upsizing the transformer and an increase in costs become problems.

In the method (2), alternating output of the full-bridge type circuit in the DC-AC conversion circuit before the discharge lamp is lighted (under no load) becomes a problem. That is, as well known, if the polarity of the supply voltage when the discharge lamp breaks down by a start signal is always limited to defined polarity, the transition of the discharge lamp to ark discharge can be made stably. This means that the bridge alternating operation should not be performed before the discharge lamp is lighted. However, the voltage doubler circuit is a circuit configured based on the premise that the alternating operation of the full-bridge type circuit is performed. (For example, the second capacitor is charged during the positive voltage period of a square wave provided from the output terminal of the full-bridge type circuit, and charges are transferred from the second capacitor to the first capacitor during the negative voltage (or ground) period of square wave, then the terminal voltage of the capacitor is raised. Thus, it runs counter to the lighting method of fixing the polarity of the supply voltage to the discharge lamp to one polarity before the discharge lamp is lighted.

In the method (3), the transformer in the DC-DC converter is provided with one additional secondary winding and it becomes necessary to raise the withstand voltage for the transformer, thus the transformer is upsized and costs are increased.

SUMMARY OF THE INVENTION

It is therefore an object of the invention to simplify the circuit configuration for supplying voltage to a starter circuit in a discharge lamp lighting circuit and reduce the costs of the lighting circuit.

To the end, according to the invention, there is provided a discharge lamp lighting circuit comprising a DC power supply circuit for receiving DC input voltage and outputting any desired DC voltage, a DC-AC conversion circuit being placed at the stage following the DC power supply circuit for converting the output voltage thereof into AC voltage and then supplying the AC voltage to a discharge lamp, and a starter circuit for generating a start signal to the discharge lamp, superposing the start signal on the output voltage of the DC-AC conversion circuit, and applying the resultant signal to the discharge lamp. In the discharge lamp lighting circuit, (a) the starter circuit has a transformer and a secondary winding of the transformer is connected at one end to an output terminal of the DC-AC conversion circuit and at an opposite end to the discharge lamp;

(b) a primary circuit containing a primary winding of the transformer is provided with a first capacitor and a switch element and when the switch element conducts, the first capacitor is discharged and generated voltage at this time is increased by the transformer, then is applied to the discharge lamp via the secondary winding of the transformer;

(c) a second capacitor placed at the output stage of the DC power supply circuit is charged when the output voltage of the DC power supply circuit is equal to or greater than one threshold value; and (d) a third capacitor is placed at the stage following the DC power supply circuit and a cycle is repeated wherein when the output voltage of the DC power supply circuit is less than the threshold value, charges accumulated in the second capacitor are transferred to the third capacitor and when the output voltage of the DC power supply circuit is equal to or greater than the threshold value, charges accumulated in the third capacitor are transferred to the first capacitor, whereby terminal voltage of the first capacitor is raised and then finally reaches a sufficient voltage value for the switch element to conduct.

Therefore, according to the invention, a cycle is executed wherein the charge transfer from the second capacitor to the third capacitor and the charge transfer from the third capacitor to the first capacitor are repeated, whereby the terminal voltage of the first capacitor is raised and when the voltage reaches a sufficient voltage value for the switch element to conduct, the start signal is applied to the discharge lamp via the second winding of the transformer, so that the circuit configuration for providing supply voltage to the starter circuit can be simplified.

DETAILED DESCRIPTION OF THE PREFERRED EMBODIMENTS

Figure 1:
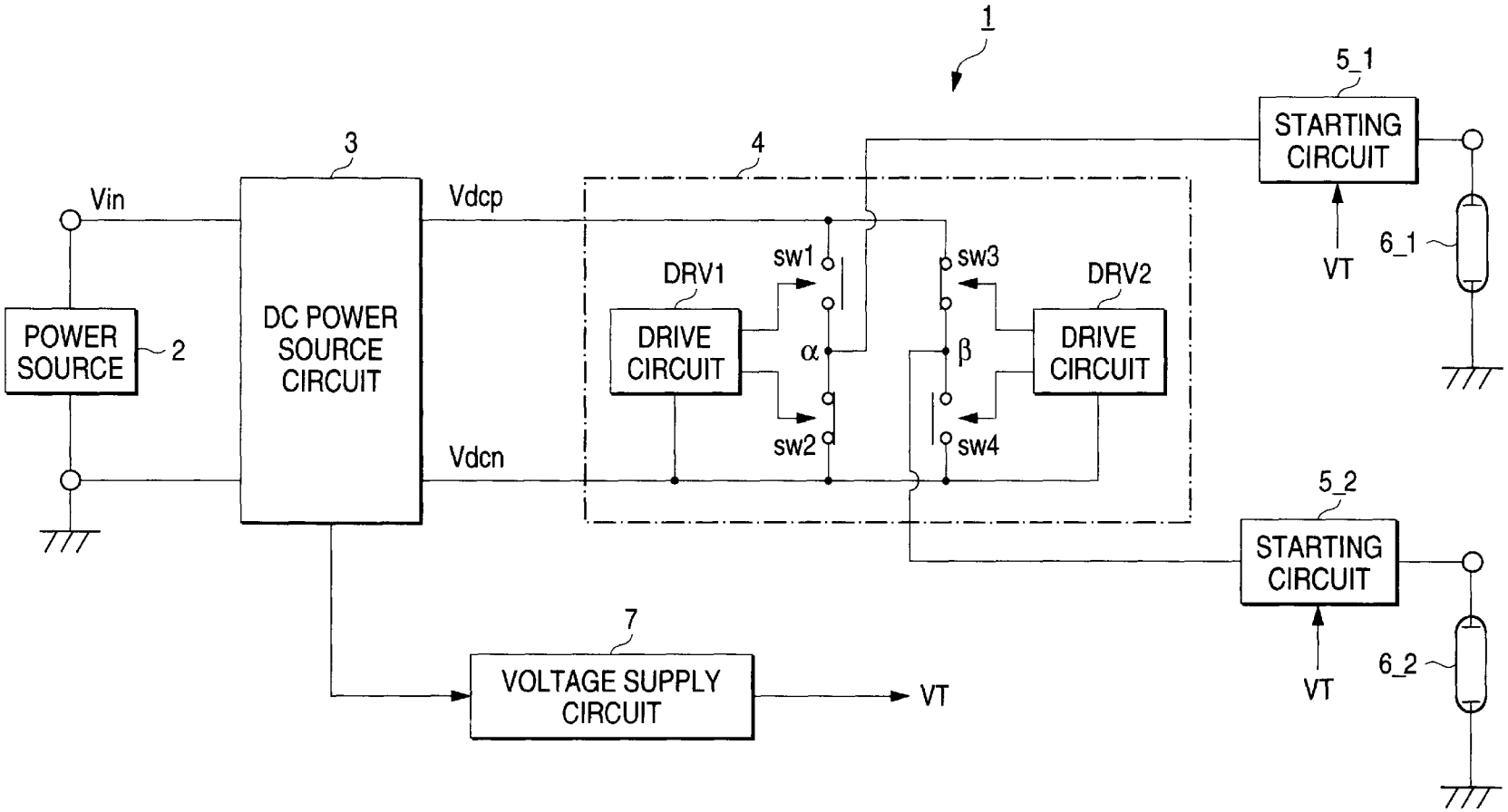
FIG. 1 is a circuit block diagram to show the basic configuration of a discharge lamp lighting circuit according to the invention.

FIG. 1 shows the basic configuration of a discharge lamp lighting circuit according to the invention.

A discharge lamp lighting circuit 1 comprises a power supply 1, a DC power supply circuit 3, a DC-AC conversion circuit 4, and a starter circuit 5.

The DC power supply circuit 3 receives DC input voltage (Vin) from the power supply 2 and outputs any desired DC voltage. The output voltage is variable-controlled in response to a control signal from a control circuit 8 described later. The DC power supply circuit 3 uses DC-DC converters each having the configuration of a switching regulator (chopper type, flyback type, etc.,); a first circuit part (DC-DC converter 3A) for providing positive-polarity voltage output (positive voltage output) and a second circuit part (DC-DC converter 3B) for providing negative-polarity voltage output (negative voltage output) are placed in parallel with each other.

Figure 2A:
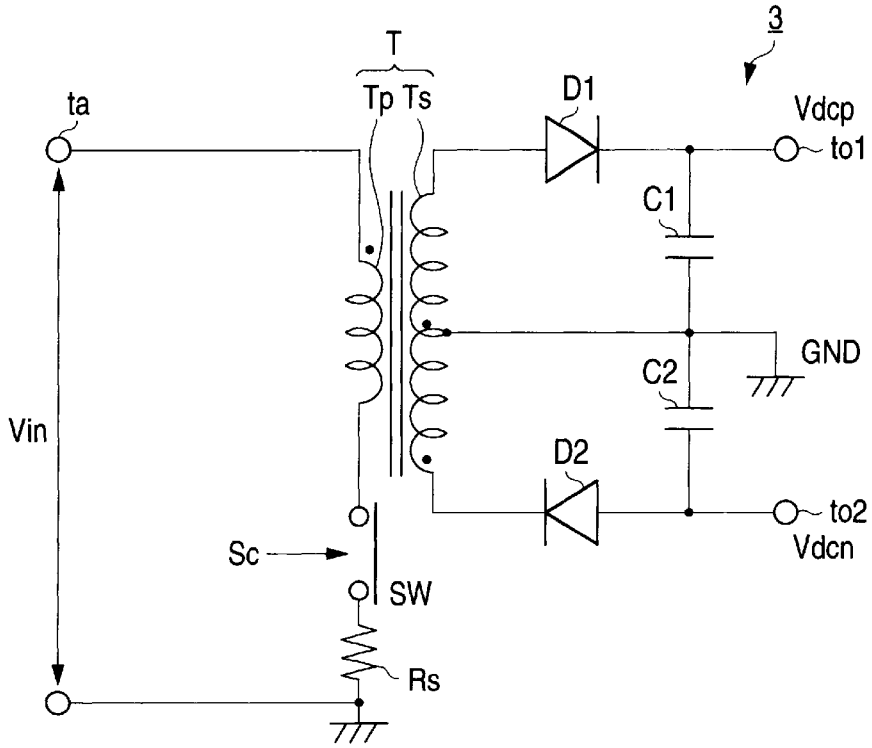
FIG. 2 is a circuit diagram to show a configuration example of a DC power supply circuit.
Figure 2B:
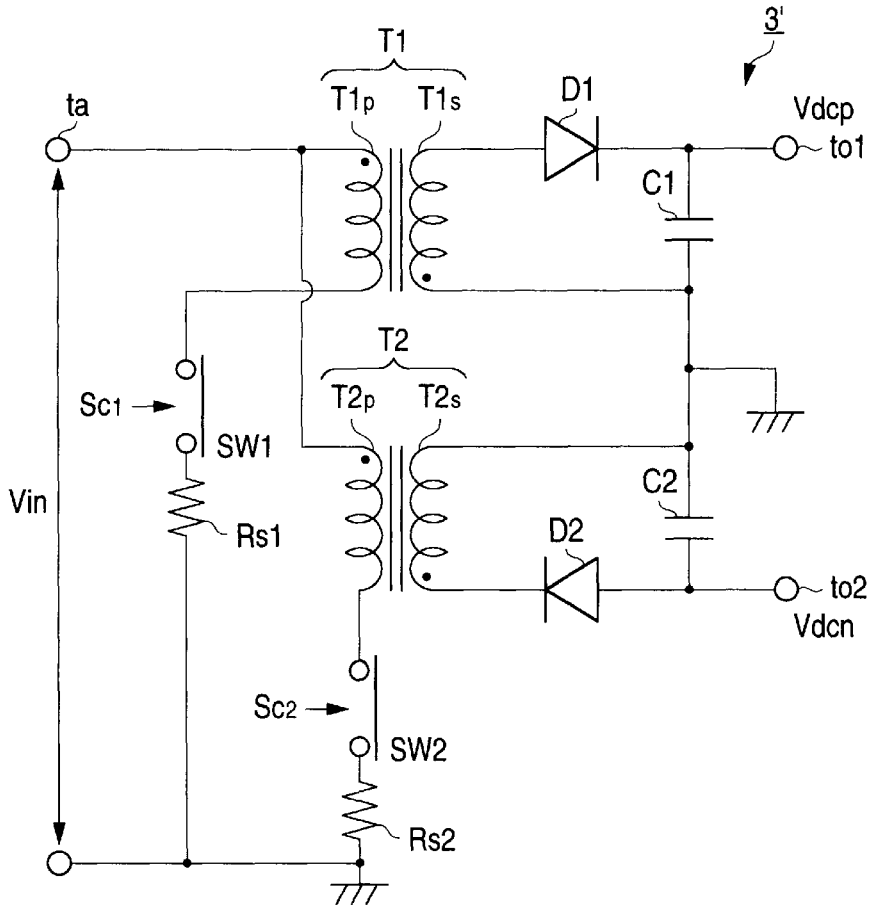

FIG. 2 shows a configuration example of the DC power supply circuit 3.

A primary winding Tp of a transformer T is connected at one end to a DC input terminal ta, whereby the voltage Vin is input. The primary winding Tp is grounded at an opposite end via a semiconductor switch element SW (simply indicated by a switch symbol in the figure; a field-effect transistor, etc., is used) and a current detection resistor Rs, which is arbitrary and need not necessarily be provided. A signal Sc from the control circuit (not shown) is supplied to a control circuit of the semiconductor switch element SW (a gate if the switch element SW is an FET) for performing switching control of the semiconductor switch element SW.

A secondary winding Ts of the transformer T is connected at one end (see terminal tpa) to an anode of a diode Da and a cathode of the diode Da is grounded via a capacitor Ca. Terminal voltage of the capacitor Ca becomes output voltage (Vdcp) via a terminal tol. The secondary winding Ts is connected at an opposite end (see terminal tpb) to a cathode of a diode Db and an anode of the diode Db is grounded via a capacitor Cb and is connected to a terminal to2. Output voltage (Vdcn) is provided through the terminal to2.

Thus, the DC power supply circuit 3 outputs the positive-polarity voltage Vdcp (>0) and the negative-polarity voltage Vdcn (<0) separately from the two output terminals tol and to2.

The "." mark added to each winding of the transformer T denotes the winding start; for example, the "." mark is added to each of the connection end to the diode Db and the winding start end at an intermediate tap (see terminal tpc) grounded.

The DC-AC conversion circuit 4 is placed at the stage following the DC power supply circuit 3 for converting the output voltage of the DC power supply circuit 3 into AC voltage and then supplying the AC voltage to a discharge lamp 6. The positive-polarity voltage and the negative-polarity voltage are sent separately from the two output terminals of the DC power supply circuit 3 to the DC-AC conversion circuit 4. To switch the output voltage Vdcp of the DC-DC converter 3A and the output voltage Vdcn of the DC-DC converter 3B, a pair of semiconductor switch elements swl and sw2 (simply indicated by switch symbols in the figure although field-effect transistors, etc., are used as the switch elements) provided in the DC-AC conversion circuit 4 is operated alternately by a drive circuit DRV, and the generated AC voltage is supplied to the discharge lamp 6.

That is, one of the two switch elements swl and sw2 connected in series at the output stage of the DC power supply circuit 3, sw1, is connected to the output terminal of the DC-DC converter 3A and also to the output terminal of the DC-DC converter 3B via sw2. For example, an IC (integrated circuit) known as a half-bridge driver is used as the drive circuit DRV for performing switching control of the switch elements reciprocally. That is, the half bridge alternating operation is performed so that when the element swl is on, the element sw2 is turned off and that when the element swl is off, the element sw2 is turned on based on signals supplied to the control terminals of the switch elements from the drive circuit DRV, whereby the DC voltage is converted into AC voltage. As shown in FIG. 1, the drive circuit DRV is operated based on the negative-polarity voltage of the voltage Vdcn. Therefore, power supply voltage for the drive circuit DRV becomes necessary. Similar consideration is also required for a control signal (clock signal) input to the drive circuit DRV.

The starter circuit 5 is provided for generating a start signal (high voltage pulse) for the discharge lamp 6 for starting the discharge lamp 6. The start signal is superposed on AC voltage Vout output by the DC-AC conversion circuit 4 and is applied to the discharge lamp 6. That is, the starter circuit 5 contains an inductive load (inductance component) and the discharge lamp 6 is connected at one electrode terminal to a connection point A of the switch elements sw1 and sw2 via the inductive load and at the other electrode terminal to ground (GND) directly or via current detection means (current detection resistor, coil, etc.,), whereby it is grounded. The starter circuit 5 receives voltage supply from the DC-DC converter 3A.

Figure 3:
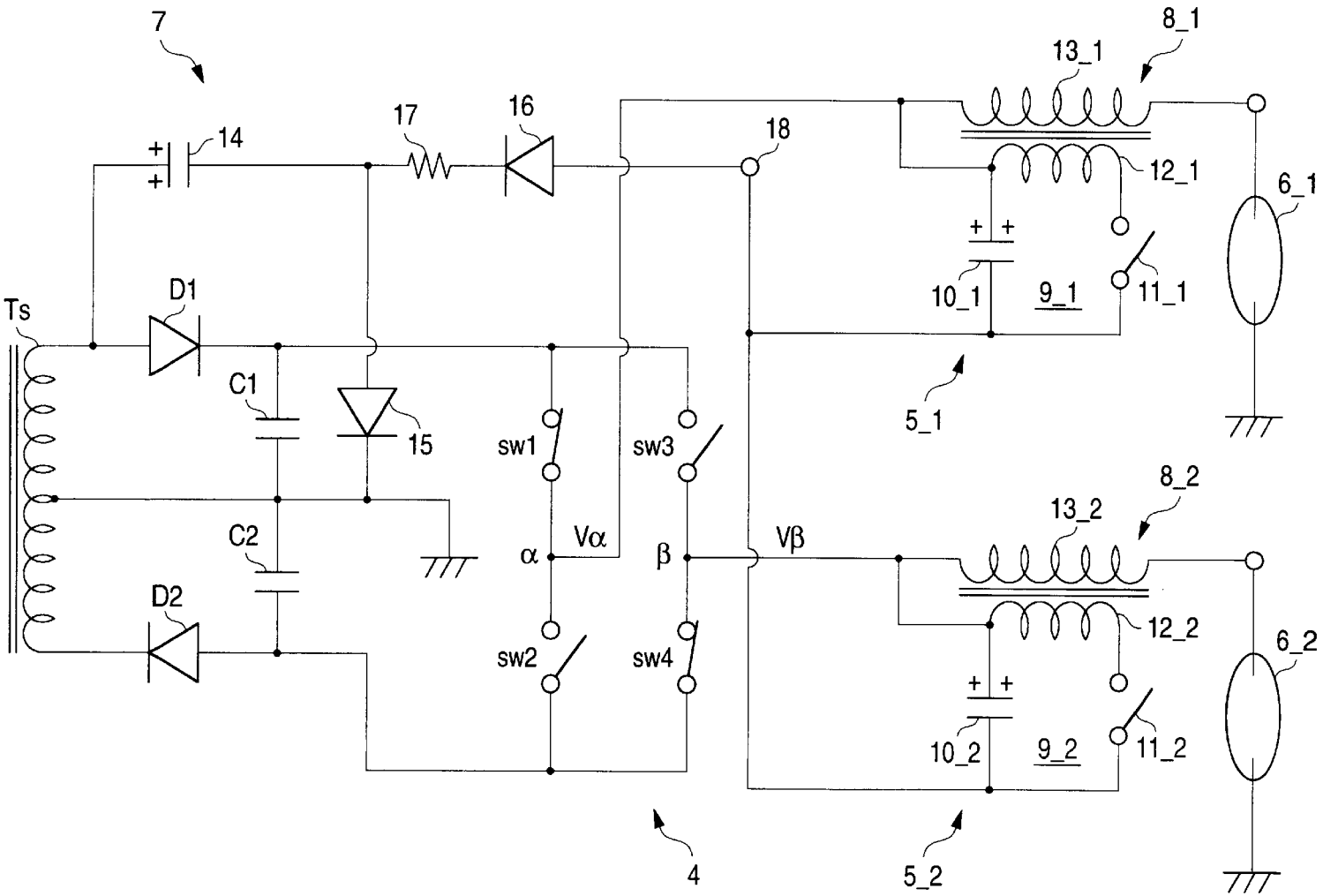
FIG. 3 is a circuit diagram to show a configuration example of a starter circuit.

FIG. 3 shows a configuration example of the starter circuit 5.

A transformer (starter transformer) ST in the starter circuit 5 comprises a secondary winding STb relative to a primary winding STa and the secondary winding STb is connected at one end to the above-mentioned connection point A (see FIG. 1) and at an opposite end to the discharge lamp 6. This means that the secondary winding STb corresponds to the above-mentioned inductive load.

A primary circuit 10 containing the primary winding STa comprises a capacitor CS and a switch element SWg ((simply indicated by a switch symbol in the figure; a discharge gap element, a thyristor, a triac, etc., is used). When the switch SWg conducts (or breaks down), the capacitor CS is charged and the generated voltage at this time is increased by the transformer ST and is applied to the discharge lamp 6 through the secondary winding STb. For example, primary voltage (or start voltage) Vp is supplied to the capacitor CS via a resistor 11 and a forward diode 12, whereby the capacitor CS is charged and when the terminal voltage of the capacitor CS reaches a predetermined threshold voltage, the switch element SWg operates and the capacitor CS is charged, so that voltage is generated on the primary winding STa.

The supply method of the primary voltage Vp will be discussed later in detail.

For example, a configuration for directly detecting an electric current flowing into the discharge lamp by the above-mentioned current detection means (in FIG. 1, current detection resistor Ri) or a configuration for acquiring a current detection signal or a voltage detection signal at the stage following the DC power supply circuit 3 can be named as a detection circuit for detecting voltage or current related to the discharge lamp 6. As an example of the latter, as shown in FIG. 1, voltage detection means 7A and 7B (for example, each a circuit for detecting output voltage with a partial pressure resister, etc.,) are placed immediately following the DC-DC converters 3A and 3B respectively and a detection signal of output voltage detected by the means can be used as an alternative signal to a voltage detection signal related to the discharge lamp 6.

The control circuit 8 is provided for controlling voltage, current, or supply power of the discharge lamp 6 in response to the detection signal from the above-mentioned detection circuit. It sends a control signal to the DC power supply circuit 3, thereby controlling the output voltage or sends a control signal to the drive circuit DRV for controlling polarity switching of the bridge. The control circuit 8 also performs output control to reliably light the discharge lamp 6 by raising the supply voltage to the discharge lamp 6 to one level before the discharge lamp 6 is lighted.

A current auxiliary circuit 9 placed between the DC power supply circuit 3 and the DC-AC conversion circuit 4 is provided for aiding in reliably making the transition from glow discharge to arc discharge by supplying energy accumulated in a capacitive load provided in the current auxiliary circuit 9 to the discharge lamp 6 when the discharge lamp 6 is started. In FIG. 1, the current auxiliary circuit 9 is placed at the stage following the DC-DC converter 3A, because the polarity of the voltage supplied to the discharge lamp 6 before the discharge lamp 6 is started is defined to be positive. That is, if the polarity of the supply voltage is defined to be negative, a current auxiliary circuit 9' may be placed at the stage following the DC-DC converter 3B as indicated by the alternate long and short dash line in FIG. 1.

Figure 4:
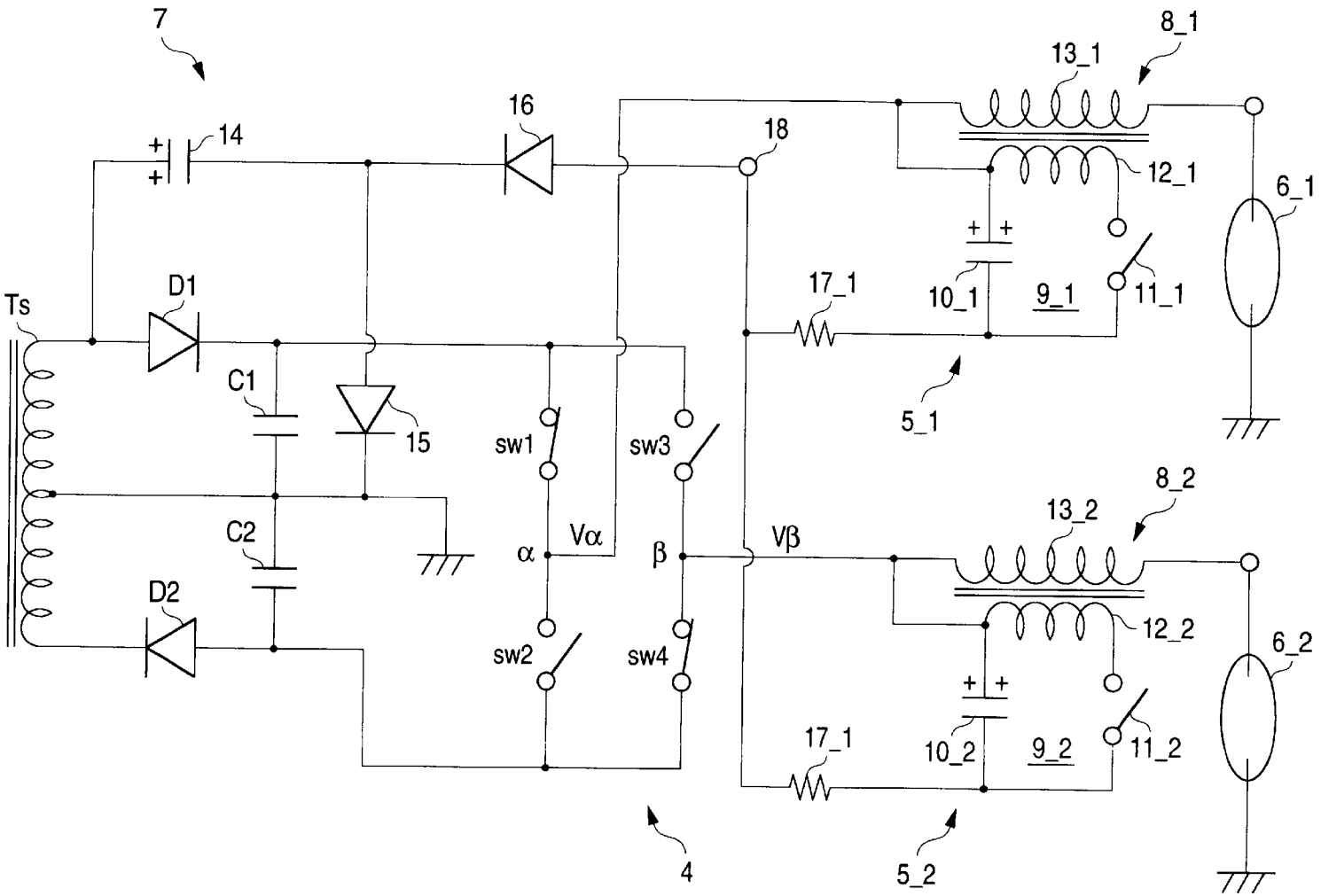
FIG. 4 is a drawing to show the main part of circuit configuration to describe power supply to the starter circuit.

FIG. 4 shows a configuration example of the main parts of the DC power supply circuit and the starter circuit (the output stage of the DC power supply circuit 3 and only the primary circuit of the starter circuit 5) to describe supply of the primary voltage Vp.

The circuit shown in FIG. 4 uses first to third diodes D1, D2, and D3 and first to third capacitors C1, C2, and C3 as two-terminal directional switch element. Charge transfer from the second capacitor C2 to the third capacitor C3 and charge transfer from the third capacitor C3 to the first capacitor C1 are repeated, whereby the terminal voltage of the first capacitor C1 is increased and when the voltage reaches a sufficient voltage value for the switch element Swg to conduct (or break down), a start signal is applied to the discharge lamp 6 through the secondary winding STb of the transformer ST.

That is, the first capacitor C1 corresponds to the capacitor CS in the starter circuit 5 (see FIG. 3) and the third diode D3 corresponds to the above-mentioned diode 12.

The first diode D1 and the second capacitor C2 are elements placed at the output stage of the DC power supply circuit 3 and correspond to the diode Da in FIG. 2 and the capacitor Ca (smoothing capacitor) respectively. That is, the first diode D1 in the DC power supply circuit 3 has an anode connected to the terminal tpa and a cathode connected to one end of the second capacitor C2 and as the diode D1 conducts, the second capacitor C2 is charged (the terminal voltage of the capacitor is output as the above-mentioned Vdcp).

The third capacitor C3 placed in parallel with the first diode D1 is connected at one end to the terminal tpa and at an opposite end between the first diode D1 and the second capacitor C2 via the second diode D2. That is, the second diode D2 is connected in series with the third capacitor C3 and has an anode connected between the first diode D1 and the second capacitor C2 and a cathode connected to the anode of the first diode Dl via the third capacitor C3.

The charge transfer from the third capacitor C3 to the first capacitor C1 is executed from a connection point K of the second diode D2 and the third capacitor C3 via a resistor R1 (corresponding to the resistor 11 in FIG. 3) and the third diode D3. That is, the third diode D3 has an anode connected to the connection point K via the resistor R1 and a cathode connected to the connection point of the first capacitor C1 and the primary winding STa.

In the circuit, before the discharge lamp is lighted, voltage Vo with a determined polarity (corresponding to the output voltage of the secondary winding of the transformer T shown in FIG. 2; in this case, positive voltage) is supplied to the terminals tpa and tpc, and voltage levels Vovc and VL are supplied alternately. If the polarity of the supply voltage to the discharge lamp before the discharge lamp is lighted is temporarily fixed to the positive polarity, the Vovc is a voltage temporarily raised by the DC-DC converter 3A and supplied to the discharge lamp, and the relation of "Vovc>VL" is true. Such output voltage level control can be easily accomplished by changing the duty cycle of the control signal to the switch element SW in the DC-DC converter 3A. That is, if switching control of the DC-DC converter 3A is performed so that vdcp becomes almost Vovc before the discharge lamp is lighted, Vovc voltage output and VL voltage output can be provided alternately because Vo is voltage before it is rectified and smoothed by the first diode D1 and the second capacitor C2.

When the voltage Vo is raised almost to Vovc, the first diode Dl conducts and the second capacitor C2 is charged. Then, when the voltage Vo is lowered to VL, the first diode D1 is brought out of conduction and the second diode D2 is brought into conduction, charging the third capacitor C3, whereby the charges accumulated in the second capacitor C2 are transferred via the second diode D2 to the third capacitor C3. When the voltage Vo is again raised almost to vovc, the second diode D2 is brought out of conduction and the third diode D3 is brought into conduction, charging the first capacitor C1. That is, at this time, the charges accumulated in the third capacitor C3 are transferred through the resistor R1 and the third diode D3 to the first capacitor C1.

As such a cycle is repeated several times, the terminal voltage of the first capacitor C1 rises and finally becomes a value of twice Vovc and reaches a sufficient voltage value for causing the switch element SWg to conduct or break down.

Therefore, this eliminates the need for raising the voltage increase ratio of the transformer as in the method (1) and the need for providing the primary voltage vp from the alternating voltage output by a bride-type circuit as in the case where the primary voltage Vp is provided by the voltage doubler circuit in the method (2). As seen from the fact that the frequency of the alternating voltage corresponds to the discharge lamp lighting frequency, the frequency generally is low (for example, about several hundred Hz), while the switching frequency related to the DC-DC converter (frequency of the control signal Sc relative to the switch element SW in FIG. 2 is high (for example, several ten kHz), so that the capacitance of the capacitor C3 can be set low. The need for adding an extra secondary wiring to the transformer in the DC-DC converter as in the method (3) is eliminated, of course.

Figure 5:
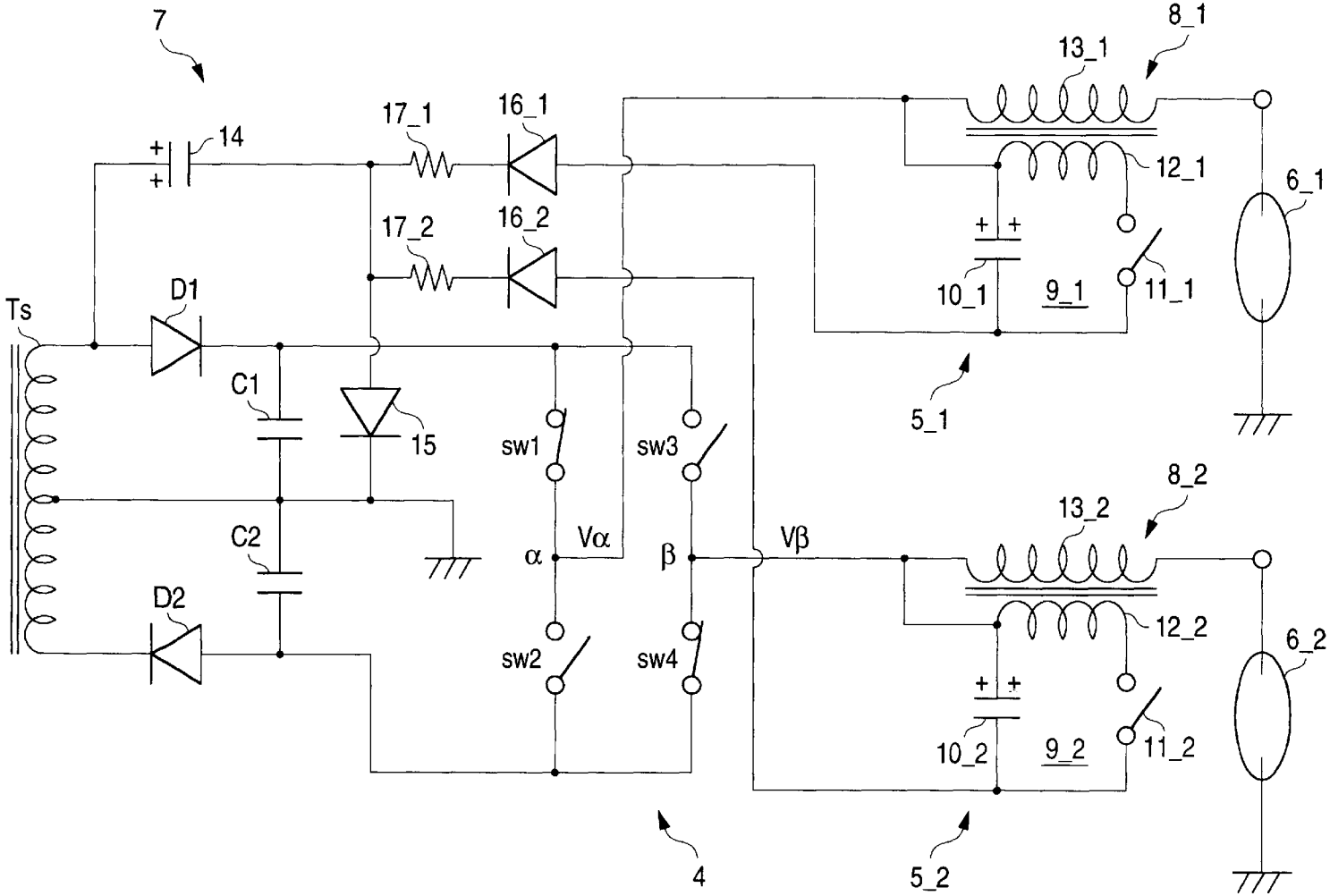
FIG. 5 is a drawing to describe the insertion positions of resistors in a series circuit of a third capacitor C3 and a second diode D2.

To limit the electric current occurring when the charges are transferred between the capacitors described above, resistors may be inserted in the series circuit comprising the third capacitor C3 and the second diode D2 connected in series, for example, as shown in FIG. 5. That is, in the example, a resistor Rc is inserted on the cathode side of the second diode D2, a resistor Rd is inserted on the anode side of the diode, a resistor Rb is inserted between the resistor Rc and the third capacitor C3, and a resistor Ra is inserted between the third capacitor C3 and the terminal tpa. The connection point of the resistors Rb and Rc is connected to the anode of the third diode D3 via the resistor R1. The design flexibility can be enhanced by selecting the positions where the resistors are to be inserted and setting the constants of resistance values, etc., considering the electric current magnitude, the capacitance of each used capacity, the time required for fully charging each capacitor, the withstand current value of each diode, etc.

In the circuit, the configuration example of using the diodes as the two-terminal directional switch element, but the invention is not limited to it and similar operation can be provided using any other element of a three-terminal active element, etc., of course. To use Vo as negative voltage, a circuit for providing a similar function to that of the circuit with respect to the above-mentioned Vdcn can also be configured.

Figure 6:
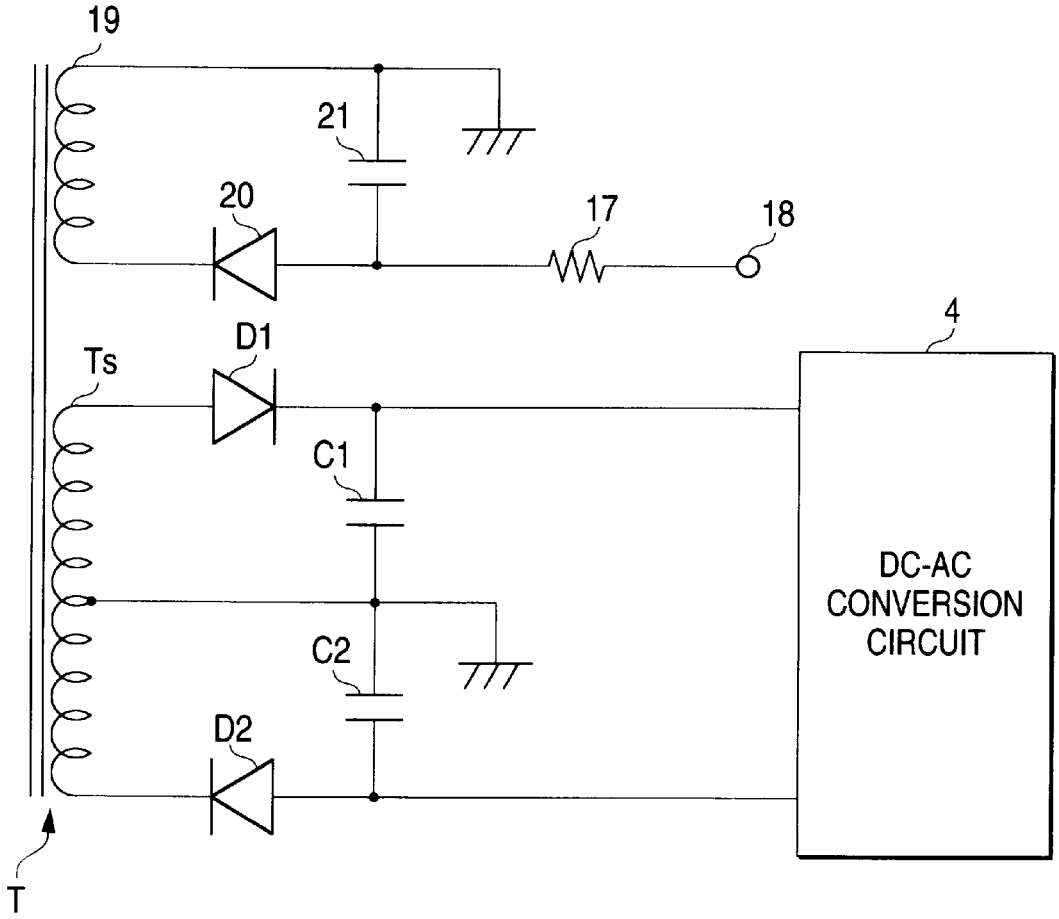
FIG. 6 shows one embodiment of the invention together with FIG. 7 and is a circuit block diagram to show a general configuration.
Figure 7:
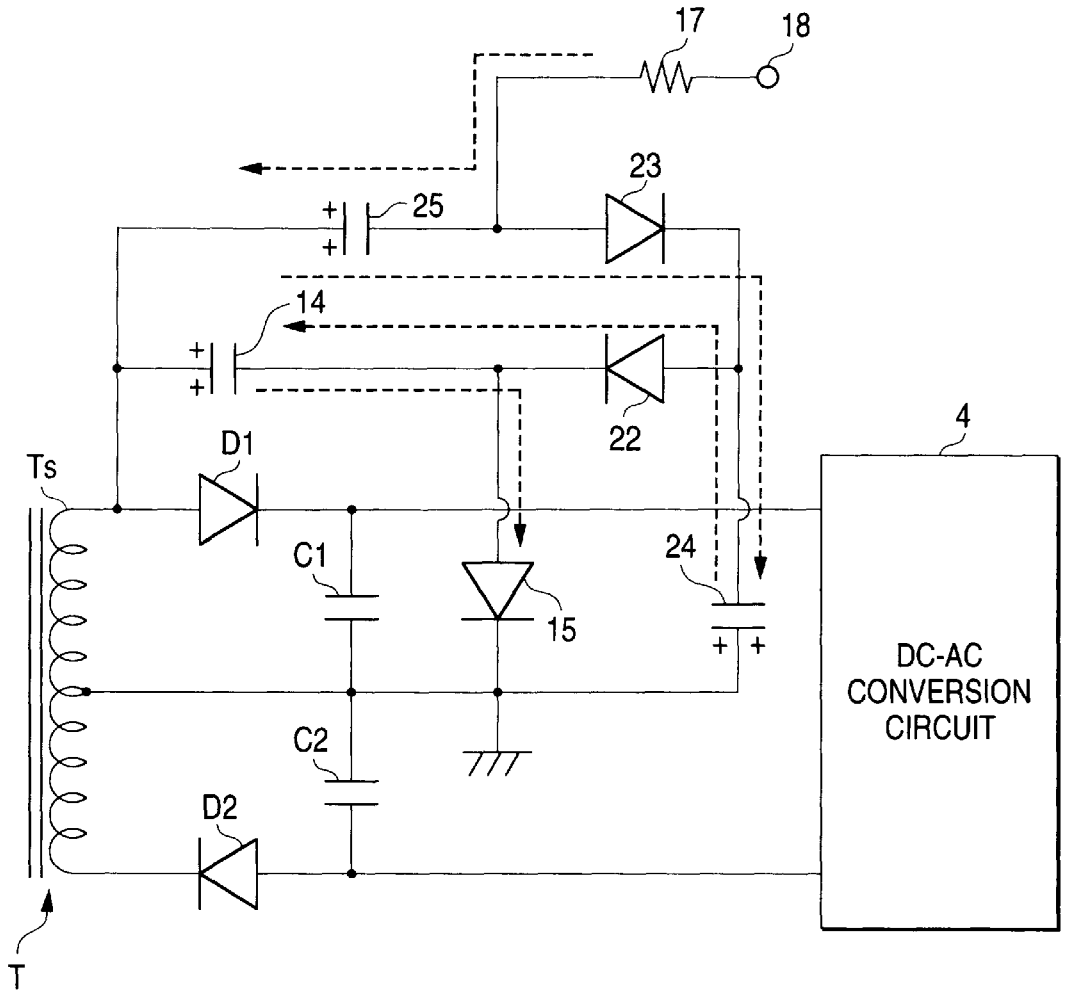
FIG. 7 is a circuit diagram to show a configuration example of a starter circuit.

FIGS. 6 and 7 show one embodiment of the invention; they shows an application example to car's front lights (circuit configuration example to use two discharge lamps).

In a lighting circuit 13, terminal voltage of a battery 14 is supplied through an input filter section 15 to a DC-DC converter 16P for positive-polarity voltage output and a DC-DC converter 16N for negative-polarity voltage output.

A control circuit 17 is provided for the DC-DC converters to control output voltages thereof, and control signals issued by the control circuit 17 are sent to the DC-DC converters. That is, in this case, switch elements connected to two primary windings in a transformer receive the control signals and are turned on/off under the control, whereby the output voltage of each DC-DC converter is controlled.

The control circuit 17 is provided for controlling power supply to the discharge lamps based on detection signals of tube voltage and tube current of each discharge lamp or their equivalent signals, such as detection signals from a detection circuit placed at the stage following the DC-DC converter 16P. For example, a circuit using an operational amplifier, etc., for generating a signal for supplying excessive power exceeding the related power at the initial stage of the discharge lamp according to a control curve in a tube voltage-tube current characteristic chart of the discharge lamp, then gradually decreasing the supplied power and making the transition to constant-power control with the related power can be named. (See JP-A-4-141988.)

The DC-DC converter 16P is followed by a current auxiliary circuit 18. That is, in the embodiment, the polarity of voltage supplied to the discharge lamp before the discharge lamp is lighted is temporarily fixed to the positive polarity.

A DC-AC converter 19 consists of a full-bridge type circuit 19*a* having a structure comprising two half bridges in parallel and a bridge drive circuit 19*b* made up of two half-bridge drivers. That is, four semiconductor switch elements provided in the full-bridge type circuit 19*a* are grouped into two pairs and switching control is performed reciprocally, whereby DC input voltage is converted into square wave voltage. For this purpose, the bridge drive circuit 19*b* generates control signals to the switch elements; it operates upon reception of a signal sent from the control circuit 17.

A starter circuit 20 is provided in common to the two discharge lamps 61 and 62 at the stage following the DC-AC converter 19. The discharge lamps 61 and 62 may be used as light sources of front lights placed on the left and right of the front of a vehicle respectively or may be used as light sources of a high beam and a low beam respectively (in this case, control is required so as not to light the unused discharge lamp in response to beam change).

For the configuration of the starter circuit 20, preferably the circuit is made common between the two discharge lamps 61 and 62 to reduce the number of parts and costs.

FIG. 7 shows such a starter circuit configuration example.

A transformer 21 in the starter circuit 20 comprises two secondary windings 21b1 and 21b2 relative to one primary winding 21*a*, and the secondary windings 21b1 and 21b2 are connected to the discharge lamps 61 and 62 respectively.

The primary circuit of the transformer 21 containing the primary winding 21*a* is provided with a capacitor 22 and a switch element 23 (in the embodiment, a spark gap element). After the capacitor 22 is charged by primary voltage Vp provided from the DC-DC converter 16P as shown in FIG. 6, it is discharged when the switch element 23 breaks down. The generated voltage at this time is increased by the transformer 21, then applied to the discharge lamps 61 and 62 via the secondary windings 21b1 and 21b2.

Preferably, the winding beginnings (or winding terminations) of the secondary windings 21b1 and 21b2 of the transformer 21 are defined as the connection terminal sides to the discharge lamps, whereby the connection relationship is unified (in the figure, the winding beginning is indicated by the "." mark). Although the reason is omitted, the polarities of the start signals to the discharge lamps are unified, whereby the withstand voltage design of the transformer is made advantageous and the supply directions of primary energy are unified, whereby the effect of the electromagnetic coupling between the secondary windings when striking potential again occurs is decreased and the discharge lamp is prevented from easily going out at the polarity switching time after the discharge lamp is lighted.

To light only one discharge lamp 61 from the state in which both the discharge lamps 61 and 62 are out, the on/off state of each switch element in the full-bridge type circuit 19*a* is defined so as to supply positive-polarity voltage to the discharge lamp 61 and supply voltage Vdcp to the discharge lamp 61 in the period is raised to the level required for the DC-DC converter 16P (Vovc), then a start signal is generated for starting the discharge lamp 61. To light only the other discharge lamp 62, the on/off state of each switch element in the full-bridge type circuit 19*a* is defined so as to supply positive-polarity voltage to the discharge lamp 62 and supply voltage Vdcp to the discharge lamp 62 in the period is raised to the level required for the DC-DC converter 16P (vovc), then a start signal is generated for starting the discharge lamp 62. Such a control sequence is adopted, whereby the current auxiliary circuit 18 needs to be provided only at the stage following the DC-DC converter 16P, so that the circuit configuration is simplified.

If one discharge lamp 61 is lighted without a problem and lighting the other discharge lamp 62 ends in failure, again the start signal is generated for starting the latter discharge lamp 62, whereby the discharge lamp can be lighted. At the time, the start signal is also applied to the lighted discharge lamp 61. However, since the impedance of the discharge lamp at the lighting time is low, the generated voltage is attenuated immediately and thus has no effect. On the other hand, the voltage generated on the secondary winding 21b2 connected to the discharge lamp 62 not lighted is a high-frequency voltage, so that the planned start signal is applied to the discharge lamp 62 with little receiving the effect of voltage attenuation on the secondary winding 21b1 connected to the discharge lamp 61.

As seen from the description made above, according to the invention, a cycle is executed wherein the charge transfer from the second capacitor to the third capacitor and the charge transfer from the third capacitor to the first capacitor are repeated in sequence, whereby the terminal voltage of the first capacitor is raised and when the voltage reaches a sufficient voltage value for the switch element to conduct, the start signal is applied to the discharge lamp via the second winding of the transformer. Thus, it is unnecessary to enlarge the voltage increase ratio of the starter transformer and add a secondary winding to the transformer in the DC-DC converter, so that the circuit configuration for providing supply voltage to the starter circuit is simplified. If the polarity of the supply voltage to the discharge lamp is fixed to one polarity before the discharge lamp is lighted, sufficient charges can be accumulated in the first capacitor.

According to the invention, the supply voltage to the starter circuit can be provided in the simple configuration using several diodes and capacitors, so that costs can be reduced.

According to the invention, a resistor is inserted in the series circuit of the third capacitor and the second diode, whereby the current flowing when the charges move can be limited to any desired current value, so that a circuit constant can be easily adjusted.

What is claimed is:

1. A discharge lamp lighting circuit comprising:

a DC power supply circuit for receiving DC input voltage and outputting a desired DC voltage;

a DC-AC conversion circuit being placed at a stage following said DC power supply circuit for converting the output voltage thereof into AC voltage and then supplying the AC voltage to a discharge lamp; and a starter circuit for generating a start signal to the discharge lamp, superposing the start signal on the output voltage of said DC-AC conversion circuit, and applying the resultant signal to the discharge lamp, wherein (a) said starter circuit has a transformer and a secondary winding of the transformer is connected at one end to an output terminal of said DC-AC conversion circuit and at an opposite end to the discharge lamp;

(b) a primary circuit containing a primary winding of the transformer is provided with a first capacitor and a switch element and when the switch element conducts, the first capacitor is discharged and the generated voltage at this time is increased by the transformer, then is applied to the discharge lamp via the secondary winding of the transformer;

(c) a second capacitor placed at an output stage of said DC power supply circuit is charged when the output voltage of said DC power supply circuit is equal to or greater than one threshold value; and (d) a third capacitor is placed at the stage following said DC power supply circuit and a cycle is repeated wherein when the output voltage of said DC power supply circuit is less than the threshold value, charges accumulated in the second capacitor are transferred to the third capacitor and when the output voltage of said DC power supply circuit is equal to or greater than the threshold value, charges accumulated in the third capacitor are transferred to the first capacitor, whereby terminal voltage of the first capacitor is raised and then finally reaches a sufficient voltage value for the switch element to conduct.

2. The discharge lamp lighting circuit as claimed in claim 1, wherein (a) as a first diode placed in said DC power supply circuit conducts, the second capacitor is charge;

(b) a second diode is connected in series with the third capacitor and has an anode connected between the first diode and the second capacitor and a cathode connected to an anode of the first diode via the third capacitor; and (c) the charge transfer from the third capacitor to the first capacitor is executed from a connection point of the second diode and the third capacitor.

3. The discharge lamp lighting circuit as claimed in claim 2, wherein a resistor is inserted in the series circuit containing the third capacitor and the second diode.

4. The discharge lamp lighting circuit as claimed in claim 2, wherein the charge transfer from the third capacitor to the first capacitor is executed from the connection point of the second diode and the third capacitor via a resistor and the third diode.

5. A discharge lamp lighting circuit comprising:

a DC power supply circuit for receiving DC input voltage and outputting a desired DC voltage, said DC power supply circuit including: a first diode which rectifies an alternative current component; a first capacitor disposed between an output of the first diode and a ground, which smoothes the output of the first diode, and a second diode and a second capacitor which are connected in parallel with the first diode;

a DC-AC conversion circuit being placed at a stage following said DC power supply circuit for converting the output voltage thereof into AC voltage and then supplying the AC voltage to a discharge lamp; and a starter circuit for generating a start signal to the discharge lamp, superposing the start signal on the output voltage of said DC-AC conversion circuit, and applying the resultant signal to the discharge lamp, said starter circuit including:

a transformer, a secondary winding of which is connected at one end to an output terminal of said DC-AC conversion circuit and at an opposite end to the discharge lamp;

a primary circuit connected with a primary winding of the transformer having a third capacitor, a switch element and a third diode an anode terminal of which is connected to a connecting portion of the second diode and the second capacitor, when the switch element conducts, the first capacitor is discharged and the generated voltage at this time is increased by the transformer, then is applied to the discharge lamp via the secondary winding of the transformer;

wherein when the output voltage of said DC power supply circuit is equal to or greater than a predetermined threshold value, the first capacitor is charged, and charges accumulated in said second capacitor are transferred to the third capacitor, and when the output voltage of said DC power supply circuit is less than the threshold value, charges accumulated in said first capacitor are transferred to the second capacitor.

* * * * *